US010078292B2

(12) United States Patent
Oikawa et al.

(10) Patent No.: US 10,078,292 B2
(45) Date of Patent: Sep. 18, 2018

(54) TONER CARTRIDGE, IMAGE FORMING APPARATUS INCLUDING THE SAME, AND METHOD FOR CONTROLLING THE IMAGE FORMING APPARATUS

(71) Applicant: S-PRINTING SOLUTION CO., LTD., Suwon-si, Gyeonggi-do (KR)

(72) Inventors: Mitsuru Oikawa, Seongnam (KR); Min-Woo Kang, Osan (KR); Jin-Hong Kim, Gwangmyeong (KR); Ho Young Lee, Yongin (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/340,557

(22) Filed: Nov. 1, 2016

(65) Prior Publication Data

US 2017/0199487 A1 Jul. 13, 2017

(30) Foreign Application Priority Data

Jan. 8, 2016 (KR) ..... 10-2016-0002532

(51) Int. Cl.
*G03G 15/08* (2006.01)
*G03G 15/00* (2006.01)

(52) U.S. Cl.
CPC ..... *G03G 15/0877* (2013.01); *G03G 15/0868* (2013.01); *G03G 15/502* (2013.01); *G03G 2215/0607* (2013.01)

(58) Field of Classification Search
CPC ..... G03G 15/0877; G03G 15/0868; G03G 15/502; G03G 2215/0607
See application file for complete search history.

(56) References Cited

U.S. PATENT DOCUMENTS

| | | | | |
|---|---|---|---|---|
| 8,532,538 | B2 * | 9/2013 | Inoue | G03G 15/0877 399/255 |
| 2006/0008281 | A1 * | 1/2006 | Matsumoto | G03G 15/0848 399/27 |
| 2011/0052222 | A1 * | 3/2011 | Furuta | G03G 15/0879 399/27 |
| 2014/0147174 | A1 * | 5/2014 | Yoshii | G03G 15/0887 399/259 |
| 2015/0205227 | A1 | 7/2015 | Yokoyama et al. | |

FOREIGN PATENT DOCUMENTS

| | | |
|---|---|---|
| JP | 2004-357202 | 12/2004 |
| JP | 2006-180429 | 7/2006 |
| JP | 2009-169275 | 7/2009 |
| JP | 2014-106473 | 6/2014 |

* cited by examiner

*Primary Examiner* — Ryan Walsh
(74) *Attorney, Agent, or Firm* — Staas & Halsey LLP

(57) ABSTRACT

A toner cartridge including a carrier container in which one surface needed for discharge of carriers faces a toner discharge outlet, an image forming apparatus, and a method for controlling the image forming apparatus are provided. The toner cartridge includes a case, a toner container in the case so as to contain the toners; a toner outlet disposed over the case so as to discharge the container toner to the outside; and a carrier container including carriers therein such that one surface of the carrier container, through which the included carriers are discharged, is arranged to face the toner outlet.

20 Claims, 18 Drawing Sheets

TONER CARTRIDGE, IMAGE FORMING APPARATUS INCLUDING THE SAME, AND METHOD FOR CONTROLLING THE IMAGE FORMING APPARATUS

CROSS-REFERENCE TO RELATED APPLICATION

This application claims the priority benefit of Korean Patent Application No. 10-2016-0002532, filed on Jan. 8, 2016 in the Korean Intellectual Property Office, the disclosure of which is incorporated herein by reference.

BACKGROUND

1. Field

Embodiments of the present disclosure relate to a toner cartridge including a toner, an image forming apparatus, and a method for controlling the image forming apparatus.

2. Description of the Related Art

Generally, image forming apparatuses are devised to print an image on a printing medium such as paper according to an input signal. Examples of image forming apparatuses include printers, copiers, facsimiles, and so-called multi-functional apparatuses that combine all or some of the functions of the aforementioned devices.

The image forming apparatus may include a main body to store or feed papers as well as to support or drive various constituent components contained therein, and a developing device mounted to the main body to form an image on papers. In this case, the developing device may include a toner cartridge to store a toner, and a developing unit to form an image on a sheet of paper using toners supplied from the toner cartridge.

The toner cartridge may store a homogeneous developer composed of toners, or may also store a heterogeneous developer in which toners and carriers are mixed.

SUMMARY

Therefore, it is an aspect of the present disclosure to provide a toner cartridge including a carrier container in which one surface needed for discharge of carriers faces a toner discharge outlet, an image forming apparatus, and a method for controlling the image forming apparatus.

Additional aspects of the present disclosure will be set forth in part in the description which follows and, in part, will be obvious from the description, or may be learned by practice of the invention.

In accordance with an aspect of the present disclosure, the toner cartridge includes a case, a toner container in the case so as to contain the toners, a toner outlet disposed over the case so as to discharge the container toner to the outside, and a carrier container including carriers therein such that one surface of the carrier container, through which the included carriers are discharged, is arranged to face the toner outlet.

The carrier container may include a carrier discharge unit provided to the one surface arranged to face the toner outlet in a manner that the carrier discharge unit is opened or closed at the one surface.

The carrier container may include a carrier outlet forming unit extended perpendicular to the carrier discharge unit, whereby, if pressure is applied to one end thereof, the other end thereof passes through the carrier discharge unit, resulting in formation of a carrier outlet.

The carrier container may include an upper cap, upon receiving pressure from an external part, configured to be movable from a first position at which the one end of the carrier outlet forming unit is pressed to a second position at which the one end of the carrier outlet forming unit is not pressed.

The carrier container may open or close the carrier discharge unit according to an external control signal.

The carrier discharge unit may be opened or closed according to the control signal which is generated on the basis of not only the amount of developer contained in the developing unit but also an average coverage, wherein the developing unit receives the developer including the toners and the carriers through the toner outlet.

The image forming apparatus may include a toner supply unit disposed between the toner outlet and the one surface of the carrier container, such that the contained toner is supplied to the outside through the toner outlet.

If the carriers are discharged from the carrier container, the toner supply unit may first supply the discharged carriers to the outside through the toner outlet.

In accordance with an aspect of the present disclosure, the image forming apparatus includes a photoconductor on which an electrostatic latent image is formed, a developing unit configured to form a toner image by supplying toners to the photoconductor; and a toner cartridge combined with the developing unit so as to supply the toners. The toner cartridge includes a case, a toner container in the case so as to contain the toners, a toner outlet disposed over the case so as to discharge the container toner to the outside, and a carrier container including carriers therein such that one surface of the carrier container, through which the included carriers are discharged, is arranged to face the toner outlet.

The carrier container may include a carrier discharge unit provided to the one surface arranged to face the toner outlet in a manner that the carrier discharge unit is opened or closed at the one surface.

The carrier container may include a carrier outlet forming unit extended perpendicular to the carrier discharge unit, whereby, if pressure is applied to one end thereof, the other end thereof passes through the carrier discharge unit, resulting in formation of a carrier outlet.

The carrier container may include an upper cap, upon receiving pressure from an external part, configured to be movable from a first position at which the one end of the carrier outlet forming unit is pressed to a second position at which the one end of the carrier outlet forming unit is not pressed.

The image forming apparatus may include a display, and a controller to control the display to display information regarding the toner cartridge.

If supply of the toners from the first toner cartridge combined with the developing unit is impossible, the controller may control the display to display a position of the upper cap of a second toner cartridge to be replaced with the first toner cartridge on the basis of an average coverage.

Assuming that the second toner cartridge includes two carrier containers, if the average coverage exceeds a first reference coverage, the controller may control the display to display an information message directing the upper cap of the two carrier containers to move to the second position. If the average coverage is less than a second reference coverage, the controller may control the display to display an information message directing the upper cap of the two carrier containers to move to the first position.

The image forming apparatus may further include: a toner detection sensor configured to detect density of the toners contained in a developer including the toners and the carriers contained in the developing unit. The controller determines whether the carriers are supplied to the developing unit using the detection result.

If the toner cartridge is combined with the developing unit, and if the carriers are not supplied from the toner cartridge using the detection result, the controller may determine whether the toner cartridge is a genuine or an imitation of the toner cartridge on the basis of the average coverage, and controls the display to display the determined result.

If the carriers are not supplied from the toner cartridge, and if the average coverage is equal to or less than a first reference coverage, the controller may control the display to display information indicating that the toner cartridge is an imitation or counterfeit.

If the carriers are supplied from the toner cartridge using the detection result, the controller may determine whether a predetermined potential is to be applied to the photoconductor in a manner that some parts of the carriers from among the developer are developed on the photoconductor on the basis of the amount of developer including the toners and the carriers contained in the developing unit.

If the carriers are supplied from the toner cartridge, and if the amount of developer contained in the developing unit exceeds the reference amount of developer, the controller may transmit a predetermined potential to the photoconductor.

The image forming apparatus may further include: a controller configured to control the carrier container to open or close the carrier discharge unit on the basis of not only the amount of developer including the toners and the carriers contained in the developing unit, but also an average coverage, If the amount of developer is equal to or less than a predetermined reference amount of developer, and if the average coverage is equal to or less than a first reference coverage, the controller may control the carrier container to open the carrier discharge unit.

In accordance with another aspect of the present disclosure, a method for controlling an image forming apparatus in which a toner cartridge, which includes a carrier container in which one face to be used for discharge of carriers is arranged to face a toner outlet, is combined with a developing unit, includes confirming information regarding the toner cartridge using at least one of the amount of developer, which includes toners and carriers contained in the developing unit, and an average coverage; and displaying information regarding the confirmed toner cartridge.

The confirming the information regarding the toner cartridge may include determining whether the toners are supplied from a first toner cartridge combined with the developing unit; and determining whether a second toner cartridge to be replaced with the first toner cartridge needs to be opened or closed on the basis of the average coverage, if it is impossible to supply the toners. The displaying the information regarding the toner cartridge may include: displaying an information message needed to open or close the second toner cartridge according to the determined result.

If the second toner cartridge includes two carrier containers, the determining whether the second toner cartridge needs to be opened or closed may include: if the average coverage exceeds a first reference coverage, displaying an information message needed to close the two carrier containers; and if the average coverage is less than a second reference coverage, displaying an information message needed to open the two carrier containers.

The confirming the information regarding the toner cartridge may include: detecting density of the toners included in the developer contained in the developing unit; and determining whether the carriers are supplied to the developing unit using the detection result.

The confirming the information regarding the toner cartridge may further include if the carriers are not supplied after the toner cartridge is combined with the developing unit, determining whether the toner cartridge is genuine or an imitation on the basis of the average coverage. The displaying the information regarding the toner cartridge may include displaying specific information indicating whether the determined toner cartridge is genuine or an imitation.

The determining whether the toner cartridge is genuine or an imitation may include: determining that the carriers are not supplied from the toner cartridge; and if the average coverage is equal to or less than a first reference coverage, determining that the toner cartridge is an imitation.

The confirming the information regarding the toner cartridge may further include: upon determining that the carriers are supplied from the toner cartridge using the detection result, determining whether the carriers of the developer need to be removed on the basis of the amount of developer contained in the developing unit.

The determining whether the carriers need to be removed may include: upon determining that the carriers are supplied from the toner cartridge, if the amount of developer contained in the developing unit exceeds the reference amount of developer, determining that the carriers of the developer contained in the developing unit need to be removed.

The method may further include if the carriers need to be removed, applying a predetermined potential to the photoconductor in a manner that some carriers of the developer in the developing unit are developed on the photoconductor of the image forming apparatus.

The method may further include opening or closing the carrier discharge unit on the basis of the confirmed information regarding the toner cartridge.

The confirming the information regarding the toner cartridge may include: determining whether the carrier discharge unit needs to be opened or closed on the basis of the amount of developer in the developing unit and an average coverage.

The opening or closing the carrier discharge unit may include if the amount of developer is equal to or less than a predetermined reference amount of developer, and if the average coverage is equal to or less than a predetermined first reference coverage, opening the carrier discharge unit.

BRIEF DESCRIPTION OF THE DRAWINGS

These and/or other aspects of the present disclosure will become apparent and more readily appreciated from the following description of the embodiments, taken in conjunction with the accompanying drawings.

DETAILED DESCRIPTION

Figure 1A:
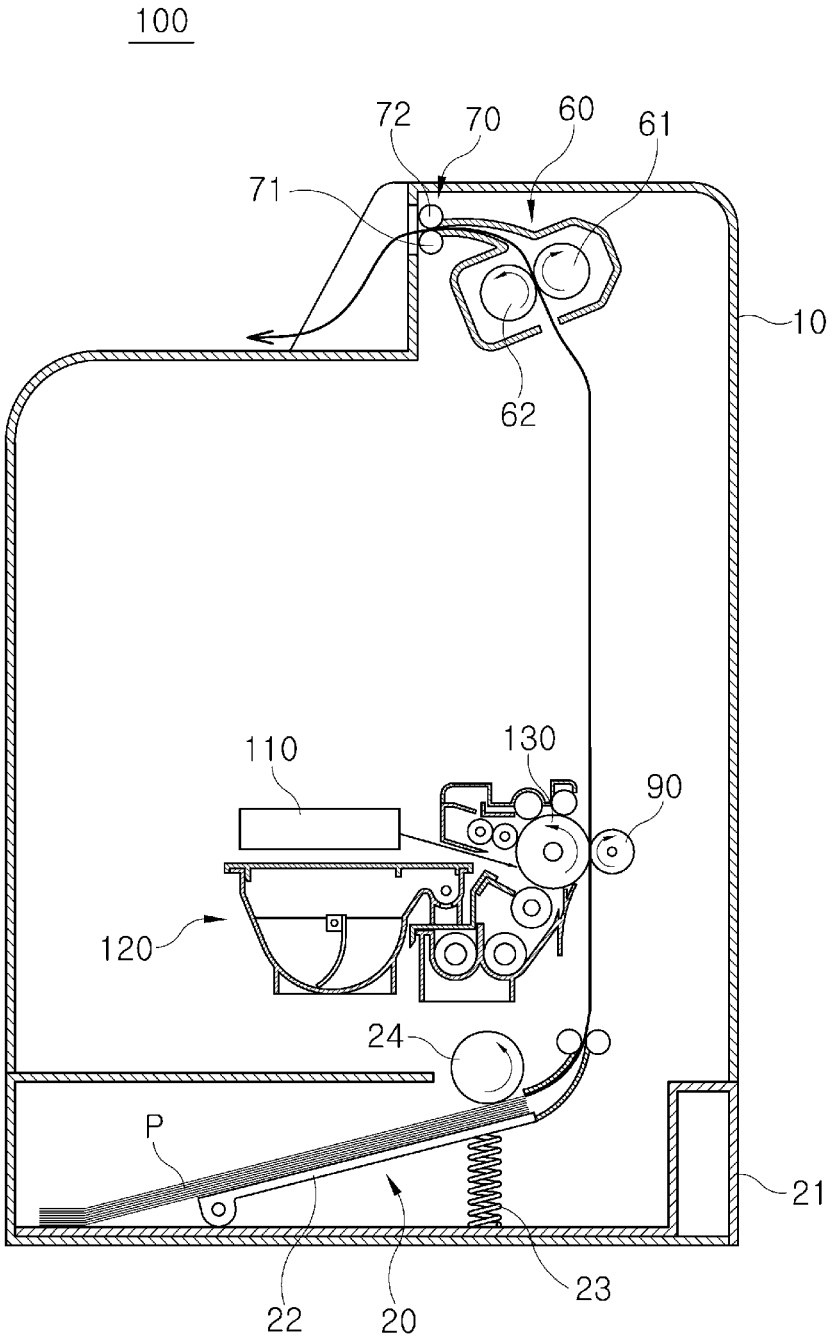
FIGS. 1A and 1B are cross-sectional views illustrating an image forming apparatus according to an embodiment of the present disclosure.

Reference will now be made in detail to the embodiments of the present disclosure, examples of which are illustrated in the accompanying drawings, wherein like reference numerals refer to like elements throughout.

Figure 1B:
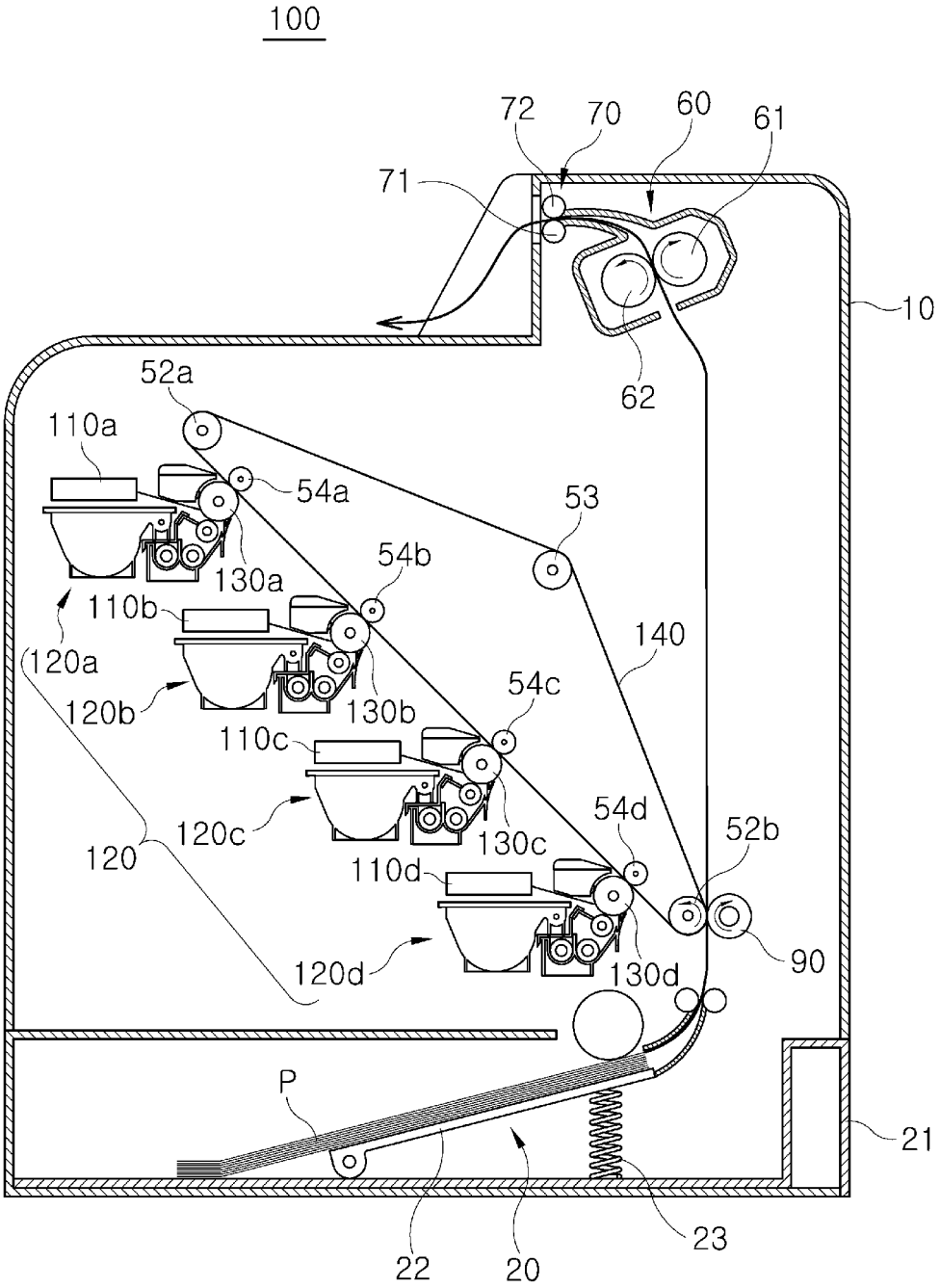

FIGS. 1A and 1B are cross-sectional views illustrating an image forming apparatus according to various embodiments of the present disclosure. FIG. 1A is a cross-sectional view illustrating an image forming apparatus for printing a monochrome image, and FIG. 1B is a cross-sectional view illustrating an image forming apparatus for printing a polychrome image.

Referring to FIG. 1A, the image forming apparatus 100 may include a main body 10 forming an external appearance thereof, a paper feeding unit 20 loaded with a plurality of sheets of paper (to be printed) at a lower part of the main body so as to provide the loaded sheets of paper when printing starts, a photoconductor 130 on which an electrostatic latent image is formed, an exposure unit 110 to irradiate the photoconductor with light such that the electrostatic latent image is formed on the photoconductor, a developing device 120 to develop a toner image by supplying toners to the photoconductor, a transfer roller 90 to transfer a toner image onto the sheet of paper, a fusing unit 60 to fuse the transferred toner image to the sheet of paper, and a paper discharge unit 70 to discharge the printed sheet of paper from the main body 10.

The paper feeding unit 20 may include a paper feeding cassette 21 detachably mounted to a bottom of the main body 10, a paper pressing plate 22 rotatable upward and downward within the paper feeding cassette 21, on which the paper P is stacked, an elastic member 23 located under the paper pressing plate 22 to elastically support the paper pressing plate 22, and a pickup roller 24 positioned at a leading end of the paper P stacked on the paper pressing plate 22, to pick up the sheet of paper. The sheet of paper is picked up by the pickup roller 24, and moves along a paper conveying path. The paper conveying path may further include a roller or a support body to assist carrying of the sheet (S) of paper.

An electrostatic latent image may be formed on the photoconductor by light irradiated from the exposure unit. The photoconductor may include a photoconductive drum in which a photoconductive layer is formed at the outer circumference of a cylindrical metal drum. The photoconductor may include a photoconductor belt in which a photoconductive layer is formed at the outer surface of the circulating belt.

The exposure unit 110 may radiate light corresponding to image information onto the photoconductor 130, and may be implemented as a laser scanning unit (LSU) which uses laser diodes as a light source. The developing device 120 includes toners, provides the toners to the photoconductor onto which the electrostatic latent image is formed, and thus forms a toner image. The developing device is described.

The transfer roller 90 may be arranged to face the photoconductor 130, and may rotate with the photoconductor 130, such that the sheet of paper passes through the space between one surface of the photoconductor 130 and the transfer roller 90, such that the developed toner image may be transferred onto the photoconductor 130.

The fusing unit 60 may fuse the toner image to the sheet of paper through heat and pressure. The fusing unit 60 may include a heating roller 61 to heat the sheet of paper onto which the transferred image has been transferred, and a pressure roller 62 installed to face the heating roller 61 to maintain a constant fusing pressure between the heating roller 61 and the pressure roller 63.

The paper discharge unit 70 may discharge the printed paper from the main body 10. For this purpose, the paper discharge unit 70 may include a discharge roller 71 and a backup roller 72 rotating with the discharge roller 71.

The image forming apparatus 100 shown in FIG. 1A may control monochrome images to be printed on the sheet of paper, such that the monochrome images may be obtained at a sufficient level when the developing device uses a monochrome toner. However, the image forming apparatus 100 configured to print polychrome images may require polychrome toners composed of different colors.

Referring to FIG. 1B, the image forming apparatus 100 may print a black (B) image, a yellow (Y) image, a magenta (M) image, and a cyan (C) image onto the sheet of paper in an overlapping manner, resulting in formation of a single polychrome image. The photoconductor 130 of the image forming apparatus 100 may include four photoconductive members (130*a*, 130*b*, 130*c*, 130*d*) onto which electrostatic latent images corresponding to black (B) image information, yellow (Y) image information, magenta (M) image information, and cyan (C) image information are respectively formed. The exposure unit 110 of the image forming apparatus 100 may include four exposure units (110*a*, 110*b*, 110*c*, 110*d*) which respectively irradiate light corresponding to image information of black (B), yellow (Y), magenta (M), and cyan (C) to four photoconductive members (130*a*, 130*b*, 130*c*, 130*d*). In addition, the developing device 120 of the image forming apparatus 100 may include a black (B) toner, a yellow (Y) toner, a magenta (M) toner, and a cyan (C) toner, and may include four developing members (120*a*, 120*b*, 120*c*, 120*d*) which respectively develop a black (B) toner image, a yellow (Y) toner image, a magenta (M) toner image, and a cyan (C) toner image on the four photoconductive members (130*a*, 130*b*, 130*c*, 130*d*).

In addition, the image forming apparatus 100 may further include an intermediate transfer member 140 acting as an intermediate medium which transfers the toner images developed on respective circumferences of the four photoconductive members (130*a*, 130*b*, 130*c*, 130*d*) onto the sheet of paper. The intermediate transfer member 140 may circulate in contact with the respective photoconductive members (130*a*, 130*b*, 130*c*, 130*d*), may be driven by the drive rollers (52*a*, 52*b*), and may maintain tensile force by the support roller 53. In addition, the image forming apparatus 100 may further include four intermediate transfer rollers (54*a*, 54*b*, 54*c*, 54*d*) which transfer toner images developed on the respective circumferences of the four photoconductive members (130*a*, 130*b*, 130*c*, 130*d*) onto the intermediate transfer member 140.

Differently from FIG. 1B, the transfer roller 90 may be arranged to face the drive roller 52*b* of the intermediate transfer member 140, and may rotate with the drive roller 52*b*, such that the sheet of paper passes through the space between one surface of the intermediate transfer member 140 and the transfer roller 90, such that the developed toner images developed on the intermediate transfer member 140 may be transferred onto the sheet of paper. As a result, the image forming apparatus 100 of FIG. 1B may print polychrome images on the sheet of paper.

Heretofore, constituent elements of the image forming apparatus 100 and the printing operation have been described. The developing device 120 in the image forming apparatus 100 will hereinafter be described. Although only one developing device 120 will hereinafter be exemplarily described for convenience of description and better understanding of the present disclosure, the developing device 120 may also be applied to the developing devices 120 of FIGS. 1A and 1B without departing from the scope and spirit of the present disclosure.

Figure 2:
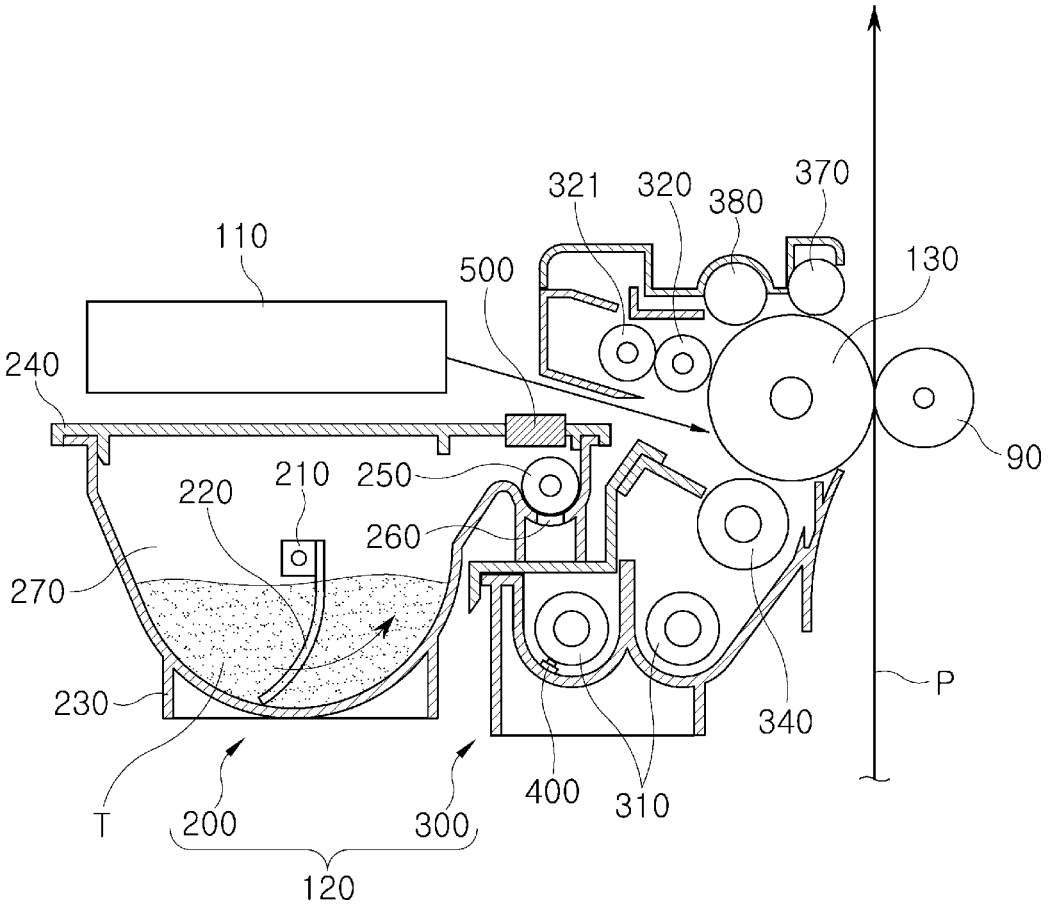
FIG. 2 is a cross-sectional view illustrating a developing device contained in an image forming apparatus according to an embodiment of the present disclosure.
Figure 3A:
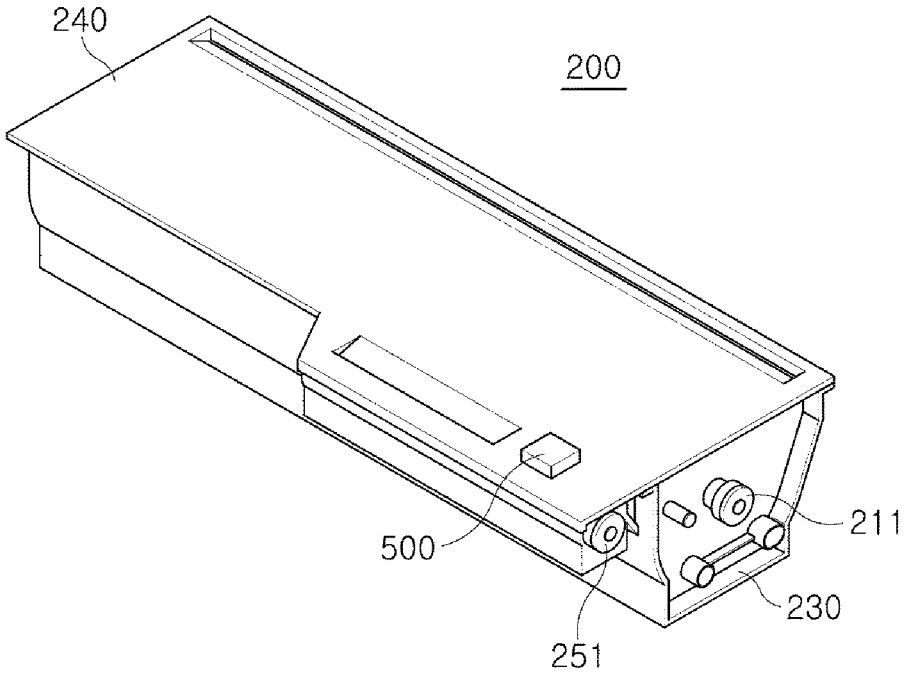
FIG. 3A is a perspective view illustrating a toner cartridge in the image forming apparatus according to an embodiment of the present disclosure.
Figure 3B:
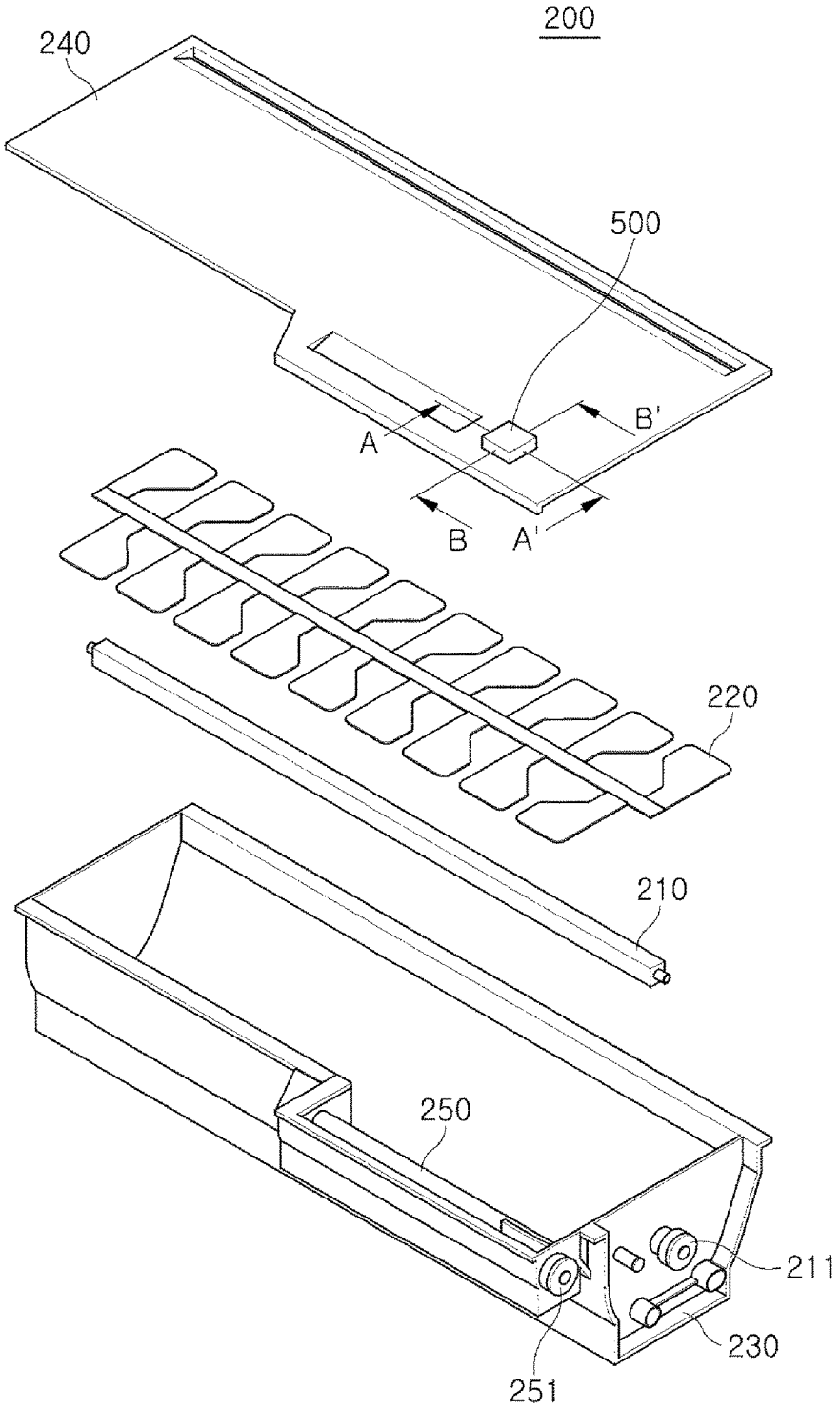
FIG. 3B is an exploded perspective view illustrating the toner cartridge in the image forming apparatus according to an embodiment of the present disclosure.

FIG. 2 is a cross-sectional view illustrating a developing device included in the image forming apparatus according to an embodiment of the present disclosure. FIG. 3A is a perspective view illustrating the toner cartridge included in the image forming apparatus according to an embodiment of the present disclosure. FIG. 3B is an exploded perspective view illustrating the toner cartridge included in the image forming apparatus according to an embodiment of the present disclosure.

The developing device 120 may include a toner cartridge 200 including at least one toner T, and a developing unit 300 to develop toner images onto the photoconductor 130 using the toner (T) received from the toner cartridge 200.

The charge roller 320 of the developing unit 300 may charge the outer circumference of the photoconductor with a uniform charge potential. The charge roller 320 may rotate in contact with the photoconductor 130, and may receive a bias voltage for charging the photoconductor 130 with electricity.

A corona charger may be used instead of the charge roller 320, such that the corona charger may charge the surface of the photoconductor 130 with electricity. In addition, a cleaning member 321 of the charge roller 320 may also be used as necessary. The cleaning member 321 of the charge roller 320 may remove dust or foreign materials attached to the charge roller 320. For this purpose, the cleaning member 321 of the charge roller 320 may be formed in a roller shape rotating in contact with the charge roller 320.

In addition, the cleaning roller 370 of the developing unit 300 may remove the remaining toners T which are not transferred onto the sheet of paper P and remain on the surface of the photoconductor 130. The cleaning roller 370 may be implemented as a rubber or sponge roller rotating in contact with the surface of the photoconductor 130.

Auxiliary charge rollers 380 and 320 may be provided at the developing unit 300. The auxiliary charge rollers 380 and 320 may pull (or draw) reversed-polarity (or negative-polarity) toners T from among the remaining toners T from the photoconductor 130, may temporarily hold the reversed-polarity toners T, and may again charge the reversed-polarity toners T with positive polarity. Each of the auxiliary charge rollers 380 and 320 may be implemented as a brush roller which rotates in contact with the surface of the photoconductor 130.

In addition, the developing unit 300 may include toners T so as to develop an electrostatic latent image into a visible image. If the homogeneous developing scheme is selected, toners T may be located in the developing unit 300. If the heterogeneous developing scheme is selected, a developer composed of toners T and carriers C may be included in the developing unit 300.

The developing unit 300 configured to develop toner images according to the heterogeneous scheme will hereinafter be described.

The developing unit 300 may further include a carrying agitator 310 to generate a developer by agitating toners T and carriers C, and a developing roller 340 to develop a toner image onto the photoconductor 130.

The carrying agitator 310 may generate a developer by combining toners T with carriers C and agitating the combined result, and may carry the generated developer to the developing roller 340. For this purpose, the carrying agitator 310 may be implemented as an auger.

The developing roller 340 may provide only the toners T included in the carried developer to the photoconductor 130, and may develop the toner image onto the photoconductor 130. For this purpose, a bias voltage may be applied to the developing roller 340. Toners T may be attached to the surface of the magnetic carriers C. The magnetic carriers C are attached to the surface of the developing roller 340 so that the carriers C may be carried to the developed region in which the photoconductor 130 faces the developing roller 340. Only toners T may be supplied to the photoconductor 130 by a bias voltage supplied between the developing roller 340 and the photoconductor 130, and the electrostatic latent image formed on the surface of the photoconductor 130 may be developed as a visible toner image.

The toner cartridge 200 may be coupled to the developing unit 300, and may provide the toners T contained therein to the developing unit 300. If the toners T contained in the toner cartridge 200 are completely consumed, the toner cartridge 200 may be replaced with a new toner cartridge 200, and may be charged with a new toner T.

The toner cartridge 200 may include a case, a toner container 270 included in the case, a toner agitator 210 and a toner agitating wing 220 to agitate toners T, a toner outlet 260 to discharge the toners T, for example, to the outside to the developing unit 300, and a toner supply unit 250 to supply the toners T to the developing unit 300 through the toner outlet 260.

Referring to FIGS. 3A and 3B, the case may include an upper case 240 and a lower case 230. The upper case 240 may be coupled to the lower case 230, and may form a toner container 270 including the toners T therein. In contrast, the upper case 240 and the lower case 230 may be integrated with each other.

The case may include a toner container 270 in which the toners T are included. The toners T included in the toner container 270 may refer to a toner T to be used for printing.

In addition, the toner container 270 contained in the case may include a toner agitator 210 and a toner agitating wing 220. The toner agitating wing 220 may be coupled to the toner container 270 using the toner agitator 210 as the center shaft, and the toner agitating wing 220 rotates with the toner agitator 210, such that the toners T contained in the toner container 270 may be agitated.

The toner supply unit 250 may carry the toners T contained in the toner container 270 to the toner outlet 260, and may supply the toners T to the developing unit 300. For this purpose, the toner supply unit 250 may be provided above the toner outlet 260. In this case, the toner outlet 260 may be formed over the lower case 230 such that the toners T can be discharged downward.

In order to drive the toner agitator 210 and the toner supply unit 250, a first coupler 211 and a second coupler 251 may be arranged at one side of the case. If the toner cartridge 200 is coupled to the developing unit 300, the drive unit 700 of the image forming apparatus is coupled to the first coupler 211 and the second coupler, and the toner agitator 210 and the toner supply unit 250 may be driven by the drive unit 700.

In a case of using a heterogeneous developing scheme, the carriers C contained in the developing unit 300 may be repeatedly used to develop the toner image, such that the carriers C may die. The dead carriers C may deteriorate the printing quality, such that supply of new carriers C is needed.

For this purpose, the toner cartridge 200 may simultaneously supply toners T and carriers C to the developing unit 300. In this case, an excess developer may be present in the developing unit 300, and the developing unit 300 may select a trickle developing scheme for carrying the deteriorated developer to the outside. In accordance with the trickle developing scheme, the developing unit 300 may form images using a newly supplied developer, and may provide the deteriorated developer to an external waste toner (T) recovery device.

However, according to the trickle developing scheme, the developing unit 300 requires a separate structure for removing the deteriorated developer, such that increasing the size and production cost of the image forming apparatus 100.

Therefore, an image forming apparatus 100 based on the simple trickle developing scheme is needed. Therefore, the toner cartridge 200 according to an embodiment may include a small amount of carriers C therein.

Referring to FIG. 2, the toner cartridge 200 may include the carriers C therein, and a carrier container 500 in which one surface through which the carriers C are discharged is arranged to face the toner outlet 260.

As described above, assuming that the toner outlet 260 is located below the case, the carrier container 500 may be located at an upper part of the toner outlet 260, namely, may be located at an upper part of the case. Assuming that the case includes an upper case 240 and a lower case 230 and the toner outlet 260 is located at a specific position of the lower case 230, the carrier container 500 may be provided at the position of the upper case 240 corresponding to an upper part in a vertical direction of the toner outlet 260. As a result, the toner supply unit 250 may be disposed between the toner outlet 260 and the carrier container 500.

The carrier container 500 may discharge the carriers C through one surface arranged to face the toner outlet 260. The carriers C have a higher density than the toners T, such that the discharged carriers C may be replaced with the toners T located below the carrier container 500. As a result, according to the toner supply unit 250, the replaced carriers C may be supplied to the developing unit 300 earlier than the toners T.

The carrier container 500 may include a carrier discharge unit 560 provided at one surface through which the carriers C are discharged. The carrier discharge unit 560 may be configured to be opened or closed, and the opening or closing of the carrier discharge unit 560 may be automatically determined by the image forming apparatus 100. In contrast, the opening or closing of the carrier discharge unit 560 may also be manually determined by a user. If the carrier discharge unit 560 is manually opened or closed by the user, the carrier discharge unit 560 may remain closed in an initial manufacturing process, and may be switched to the opening state when the toner cartridge 200 is mounted to the developing unit 300.

The carrier container 500 according to an embodiment of the present disclosure will hereinafter be described with reference to the attached drawings.

Figure 4A:
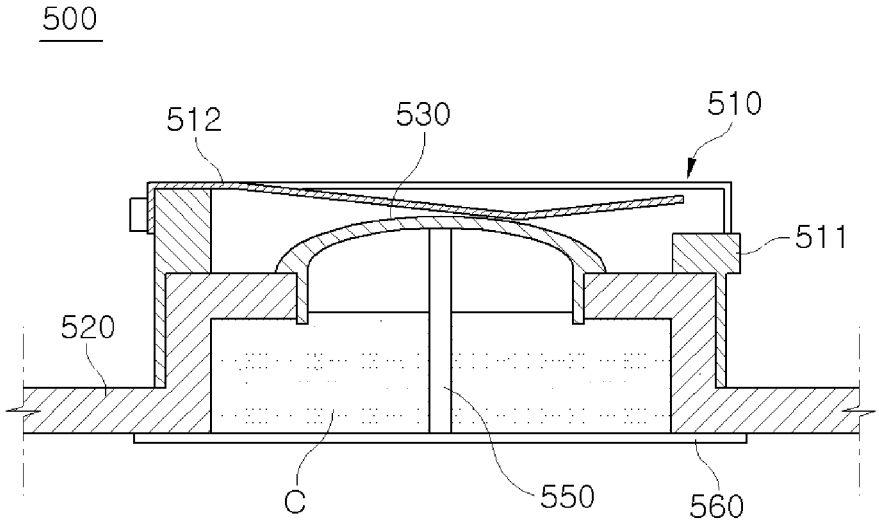
FIGS. 4A-4B are cross-sectional views illustrating a carrier container according to an embodiment of the present disclosure.
Figure 4B:
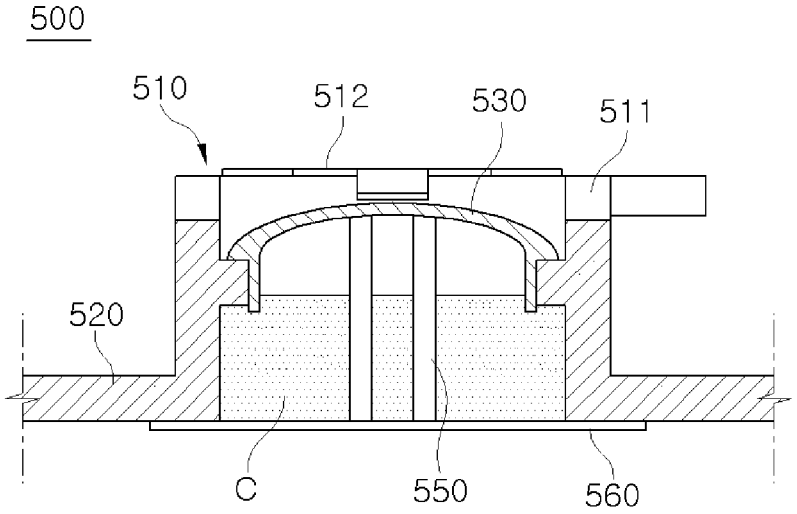

FIGS. 4A-4B are cross-sectional views illustrating a carrier container according to an embodiment of the present disclosure. FIG. 4A is a cross-sectional view illustrating the carrier container 500 taken along the line A-A' of FIG. 3B, and FIG. 4B is a cross-sectional view illustrating the carrier container 500 taken along the line B-B' of FIG. 3B.

Referring to FIGS. 4A-4B, the carrier container 500 according to an embodiment may include a housing 520 forming the space in which carriers C are included, a carrier discharge unit 560 located below the housing 520, a carrier outlet forming unit 550 to form a carrier outlet on the carrier discharge unit 560, a rubber cap 530 to transmit restoring force to the carrier outlet, and an upper cap 510 to press the rubber cap 530.

The housing 520 may form the external appearance of the carrier container 500. Although upper and lower parts of the housing 520 are opened, the upper and lower parts of the housing 530 are closed by the carrier discharge unit 560 and the rubber cap 530, resulting in formation of the space including the carriers C.

The carrier discharge unit 560 may close a lower part of the housing 520. In addition, the carrier discharge unit 560 may be manufactured as a film in a manner that the carrier outlet forming unit 550 to be described later may pass through the carrier discharge unit 560. The carrier outlet according to one embodiment may be implemented as a urethane film.

Since the carrier outlet is not formed in the carrier discharge unit 560 at the time of manufacture, the carrier outlet may remain in a closed state in which the carriers C are not discharged. However, after formation of the carrier outlet, the carrier outlet may switch to the opening state in which the carriers C are discharged through the carrier outlet.

The carrier outlet forming unit 550 may extend perpendicular to the carrier discharge unit 560. In addition, assuming that one end of the carrier outlet forming unit 550 is pressed, the other end of the carrier outlet may pass through the carrier discharge unit 560, resulting in formation of the carrier outlet. For this purpose, the other end of the carrier outlet forming unit 550 may be formed in a sharp shape. Although two carrier outlet forming units 550 are exemplarily shown in FIGS. 4A-4B for convenience of description, the number of carrier outlet forming units 550 is not limited thereto.

The rubber cap 530 may be provided at one end of the carrier outlet forming unit 550. If the rubber cap 530 is pressed and pressure is applied to one end of the carrier outlet forming unit 550, the other end of the carrier outlet forming unit 550 may pass through the carrier discharge unit 560. Thereafter, if pressure is removed, the rubber cap 530 may provide restoring force through which the carrier outlet forming unit 550 may return to an initial position thereof.

The upper cap 510 may include a fixing unit 511 fixed to the housing 510, and a moving unit 512 to pressurize the rubber cap 530 according to the position thereof. The fixing unit 511 may be configured in a shape through which the fixing unit 511 is combined with the upper part of the housing 520. The moving unit 521 may move in the range from a first position at which the rubber cap 530 is pressed to a second position at which the rubber cap 530 is not pressed.

The opening or closing state of the carrier discharge unit 560 according to the position of the moving unit 512 will hereinafter be described.

Figure 5A:
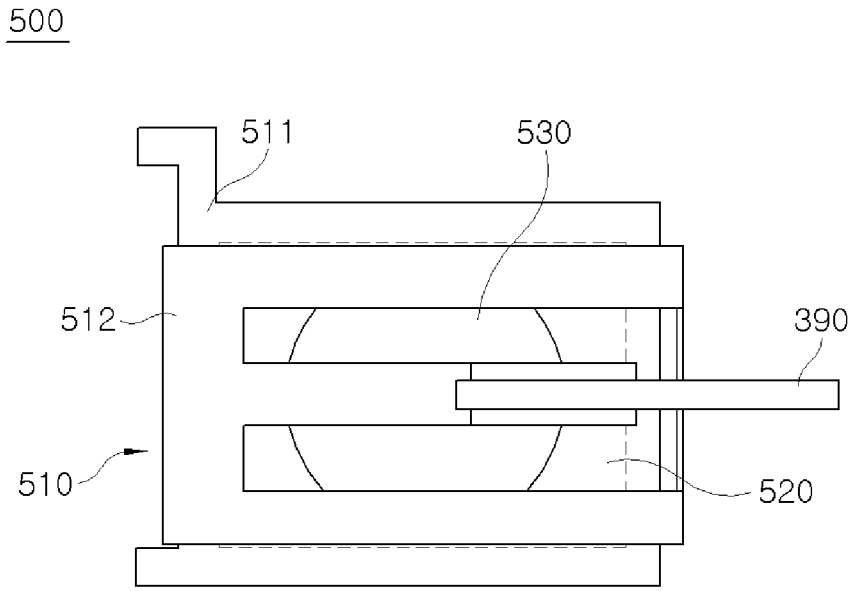
FIGS. 5A-5B are conceptual diagrams illustrating an exemplary case in which a carrier container discharges carriers according to an embodiment of the present disclosure.
Figure 5B:
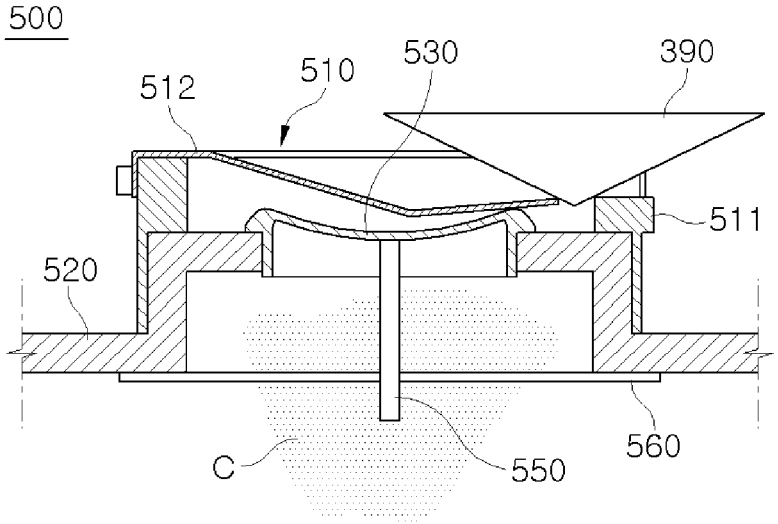
Figure 6A:
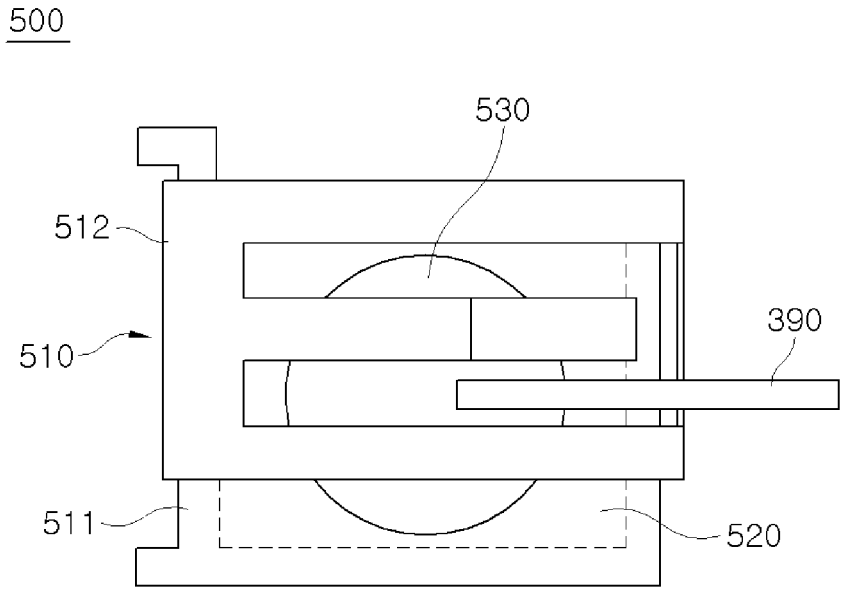
FIGS. 6A-6B are conceptual diagrams illustrating an exemplary case in which a carrier container does not discharge carriers according to an embodiment of the present disclosure.
Figure 6B:
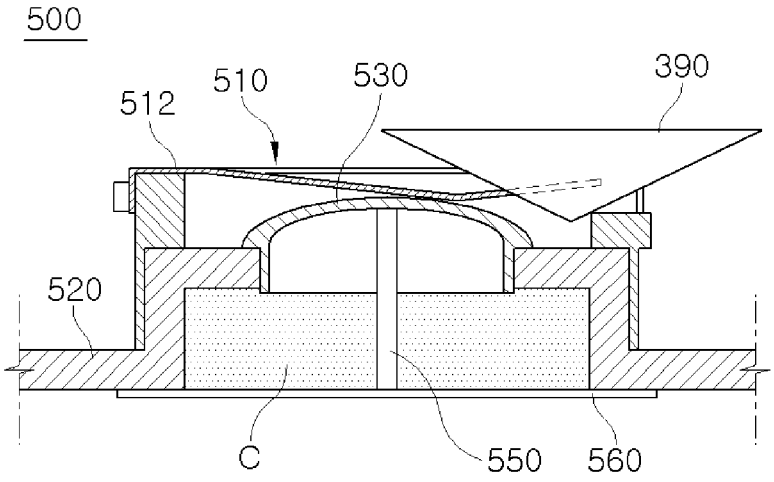

FIGS. 5A-5B are conceptual diagrams illustrating an exemplary case in which the carrier container discharges carriers according to an embodiment of the present disclosure. FIGS. 6A-6B are conceptual diagrams illustrating an exemplary case in which the carrier container does not discharge carriers according to an embodiment of the present disclosure. FIG. 5A and FIG. 6A are plan views illustrating the carrier container 500, and FIG. 5B and FIG. 6B are cross-sectional views illustrating the carrier container 500 taken along the line A-A' of FIG. 3B.

FIGS. 5A-5B exemplarily show the case in which the moving unit 512 of the upper cap 510 is located at a first position. The first position may refer to an upper part of the rubber cap 530, such that the rubber cap 530 may be pressed by the moving unit 512 at the first position. Specifically, when the toner cartridge 200 is combined with the developing unit 300, the first position may refer to a specific position at which the upper part of the rubber cap 530 is pressed by the pressing unit 390 of the developing unit 300. As a result, if the toner cartridge 200 is combined with the developing unit 300, the pressing unit 390 of the developing unit 300 may press the moving unit 512 located at the first position, and the moving unit 512 presses the rubber cap 530, such that the carrier outlet may be formed at the carrier discharge unit 560. As a result, the toner cartridge 200 may provide the carriers C supplied through the carrier outlet to the developing unit 300.

FIGS. 6A-6B exemplarily show the case in which the moving unit 512 of the upper cap 510 is located at a second position. In this case, the second position may refer to an upper part of the rubber cap 530, such that the moving unit 512 does not press the rubber cap 530 at the second position. Specifically, when the toner cartridge 200 is combined with the developing unit 300, the second position may refer to a specific position at which the upper part of the rubber cap 530 is not pressed by the pressing unit 390 of the developing unit 300. As a result, although the toner cartridge 200 is combined with the developing unit 300, the pressing unit 390 of the developing unit 300 is unable to press the moving unit 512. Therefore, the rubber cap 530 not pressed by the moving unit 512 is unable to press one end of the carrier outlet forming unit 550, such that it is impossible for the carrier outlet to be formed at the carrier outlet 560. Therefore, the toner cartridge 200 may provide only the toners T other than the carriers C to the developing unit 300.

The above-mentioned shapes of FIGS. 4A-4B, 5A-5B, and 6A-6B are merely examples of the carrier container 500, and the carrier container 500 may be implemented in various ways in a manner that one surface for discharging carriers C in the carrier container 500 is arranged to face the toner outlet 260.

Heretofore, the toner cartridge 200 including a single carrier container 500 has been described. In contrast, the toner cartridge 200 may include a plurality of carrier containers 500 as necessary.

Figure 7:
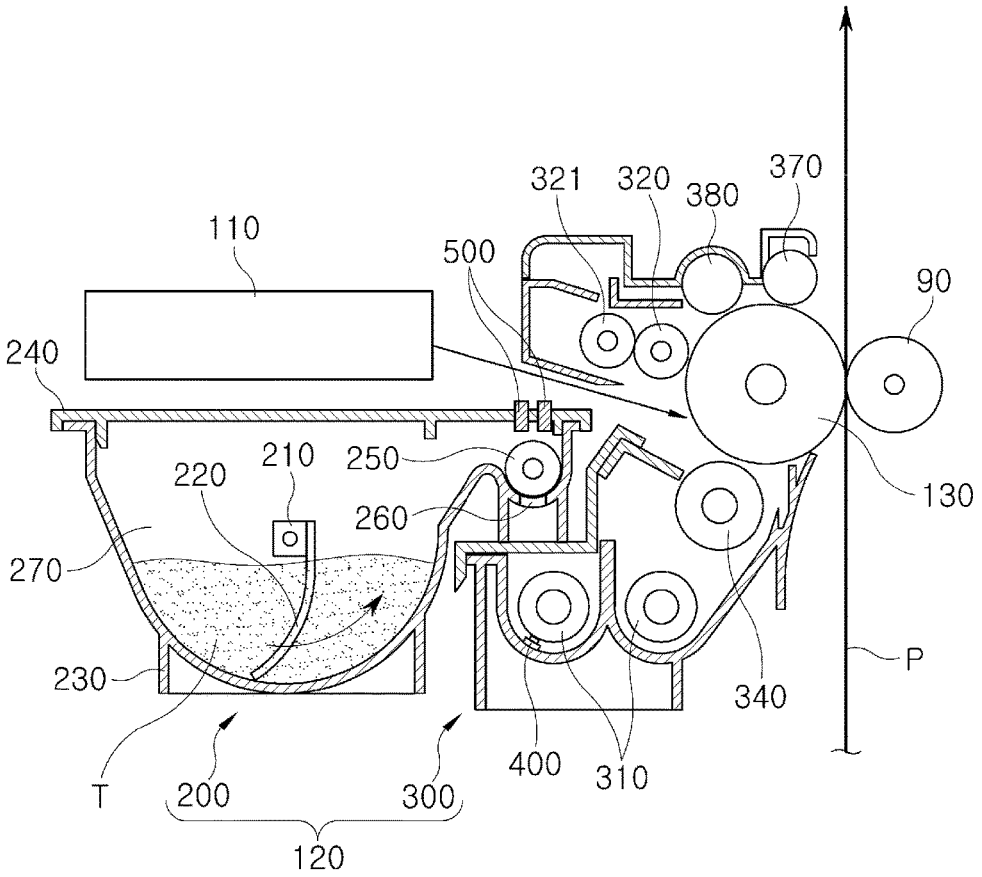
FIG. 7 is a cross-sectional view illustrating a developing device in an image forming apparatus according to another embodiment of the present disclosure.

FIG. 7 is a cross-sectional view illustrating a developing device included in an image forming apparatus according to another embodiment of the present disclosure. The other elements other than one or more carrier containers 500 of the image forming apparatus 100 of FIG. 7 are similar to those of the image forming apparatus 100 of FIG. 2, and as such a detailed description thereof will herein be omitted for convenience.

Referring to FIG. 7, the toner cartridge 200 may include two carrier containers 500. Two carrier containers 500 may be arranged to face the toner outlet 260 in which one surface for discharging all carriers C in each carrier container 500 is arranged to face the toner outlet 260 through which toners T are discharged.

In the case of using a plurality of carrier containers 500 as shown in FIG. 7, the carrier container 500 may change the amount of carriers C supplied to the inside of the toner cartridge 200. For example, since the carrier containers 500 are closed, partially opened or entirely opened, the amount of carriers C supplied to the toner cartridge 200 may be changed, such that the amount of carriers C supplied to the developing unit 300 may be changed.

The amount of carriers C supplied from the carrier container 500 to the developing unit 300 may be determined according to the amount of developer included in the developing unit 300 and the average coverage. A method for calculating the appropriate amount of carriers C supplied to the developing unit 300 will hereinafter be described with reference to FIGS. 8A and 8B.

Figure 8A:
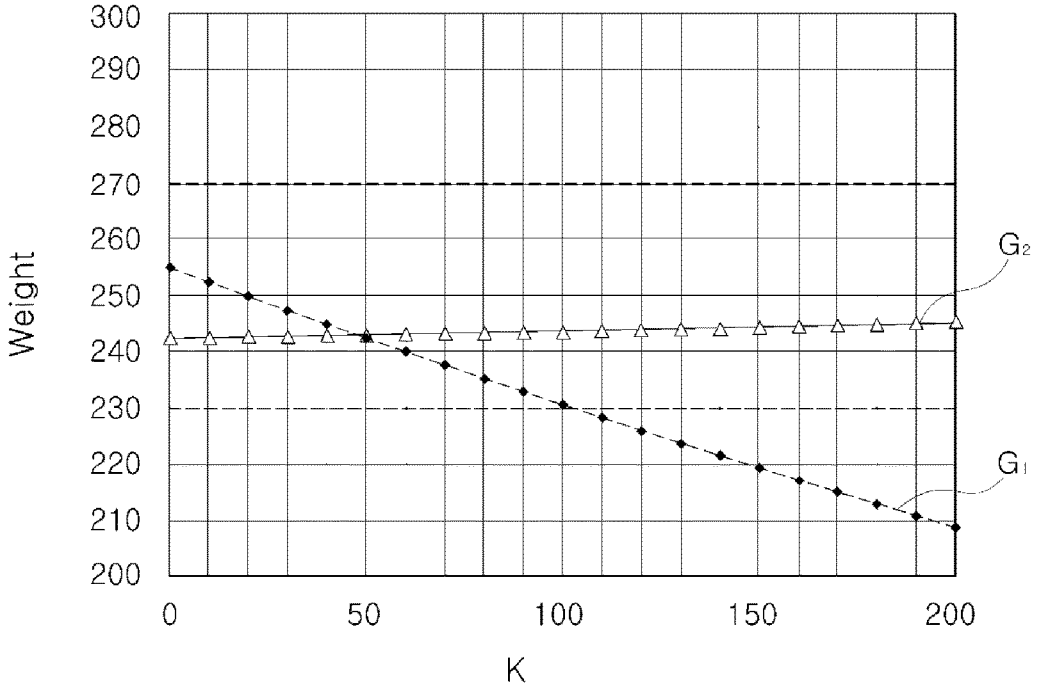
FIG. 8A is a graph illustrating the amount of developer in a developing unit in response to the number of printed sheets of the image forming apparatus according to various embodiments of the present disclosure.
Figure 8B:
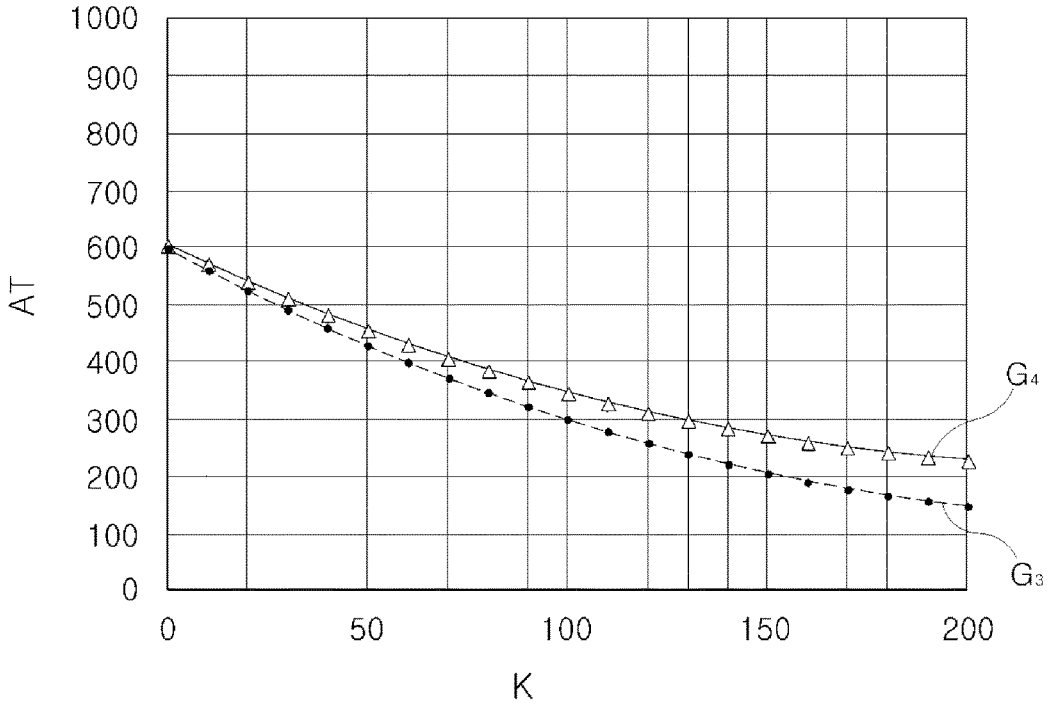
FIG. 8B is a graph illustrating degradation of a developer in response to the number of sheets of paper of the image forming apparatus according to various embodiments of the present disclosure.

FIG. 8A is a graph illustrating the amount of developer included in the developing unit in response to the number of printed sheets of the image forming apparatus according to various embodiments of the present disclosure. FIG. 8B is a graph illustrating degradation of a developer in response to the number of sheets of paper of the image forming apparatus according to various embodiments of the present disclosure.

The graph G1 shown in FIG. 8A indicates the changed amount of developer on the condition that the initial amount of developer is 255 g, the toner cartridge 200 is replaced at intervals of a printing time period of 10 k (10000 sheets of paper), and the carriers C are not additionally supplied. The graph G2 shown in FIG. 8B indicates the changed amount of developer on the condition that the initial amount of developer is 240 g, the toner cartridge 200 is replaced at intervals of a printing time period of 10 k, and toners of 250 g and carriers C of 2.5 g are additionally supplied. In G1 and G2, assume that the average coverage is 5%.

If the amount of developer in the developing unit 300 is higher than a first reference amount of developer, increase of torque for driving the developing unit 300 and the operation for preventing the developer from leaking out of the developing unit 300 occur, such that there is a possibility of causing a malfunction of the image forming apparatus 100. If the amount of developer in the developing unit 300 is less than a second reference amount of developer, inferior image density reduction such as auger mark or image pollution caused by scattering of toners T may occur.

Therefore, the amount of developer in the developing unit 300 may be between the first reference amount of developer and the second reference amount of developer. In FIG. 8A, the first reference amount of developer is 270 g, and the second reference amount of developer is 230 g.

As can be seen from the graph G1, although toners T are supplied at intervals of the printing time period of 10 k, it is confirmed that the entire amount of developer is gradually reduced. In more detail, the initial amount of developer in the developing unit 300 is reduced by about 10% at the printing time of 100 k, such that the entire amount of developer is reduced from 255 g to 230 g at the printing time of 100 k. Specifically, the amount of developer of 230 g is identical to the amount of the second reference developer, such that the printing quality may be deteriorated during the additional printing task.

Reduction of the amount of developer may occur because the small amount of carriers C is transferred to the photoconductor 130 during the developing process of the toner images. To this end, the carrier container 500 according to one embodiment may supply the carriers C to the developing unit 300 so as to discharge the carriers C, such that the reduced amount of carriers C from among the entire developer may be additionally supplied to the developing unit 300.

As can be seen from the graph G2, the carriers C of 2.5 g are additionally supplied to the inside of the developing unit 300 at the printing time of 10 k, the amount of developer in the developing unit 300 is not reduced, and may be between the first reference amount of developer and the second reference amount of developer.

The graph G3 shown in FIG. 8B indicates the deterioration curve of developer on the condition that the initial amount of developer is 255 g, the toner cartridge 200 is replaced at intervals of a printing time period of 10 k, and the carriers C are not additionally supplied. The graph G4 indicates the deterioration curve of developer on the condition that the initial amount of developer is 240 g, the toner cartridge 200 is replaced at intervals of a printing time period of 10 k, and toners of 250 g and carriers C of 2.5 g are additionally supplied. G3 and G4 may assume that the average coverage is 5%.

Typically, the developer lifespan may be ended at the printing time corresponding to 50% of the initial deterioration value. As can be seen from the graph G3, assuming that additional carriers C are not supplied, it may be determined that the developer lifespan is ended at the printing time of 100 k. In contrast, as can be seen from the graph G4, the developer lifespan reaches 50% of the initial deterioration value at the printing time of 130 k, such that the developer lifespan may increase by 30%.

Assuming that the average coverage is 2.5%, the toner cartridge 200 is replaced at intervals of the printing time of 20 k, such that toners T of 250 g and carriers C of 2.5 g may be additionally supplied to the developing unit 300. In this case, the degree of reduction of developer is reduced, and the amount of developers may reach the second reference amount of developer at the printing time of 120 k. In addition, the developer lifespan may be increased according to the deterioration curve.

Assuming that the average lifespan is 10%, the toner cartridge 200 is replaced at intervals of the printing time of 5 k, and toners T of 250 g and carriers C of 2.5 g are additionally supplied to the developing unit 300. In this case, the amount of developer is increased, such that the amount of developer may reach the first reference amount of developer at the printing time of 110 k. In addition, the developer lifespan may be extended to 160 k. Therefore, if some carriers C are removed from the entire amount of developer such that the amount of developer is equal to or less than the first reference amount of developer, the developer lifespan may be extended by 60%.

Assuming that the weight of developer as compared to toner T of the toner cartridge 200 of 10 k is set to 1%, the developer lifespan may be extended by about 30% in the range from 2.5% to 10% of the average coverage, and the amount of developer may also be stably maintained.

That is, the carrier container 500 of the toner cartridge 200 may include the carriers C corresponding to 1% of the weight of toners T contained in the toner container 270, such that the carrier container 500 may use the sufficient amount of carriers C.

Meanwhile, the image forming apparatus 100 may also provide the user with information of the toner cartridge 200 to be replaced or information of the replaced toner cartridge 200.

Figure 9:
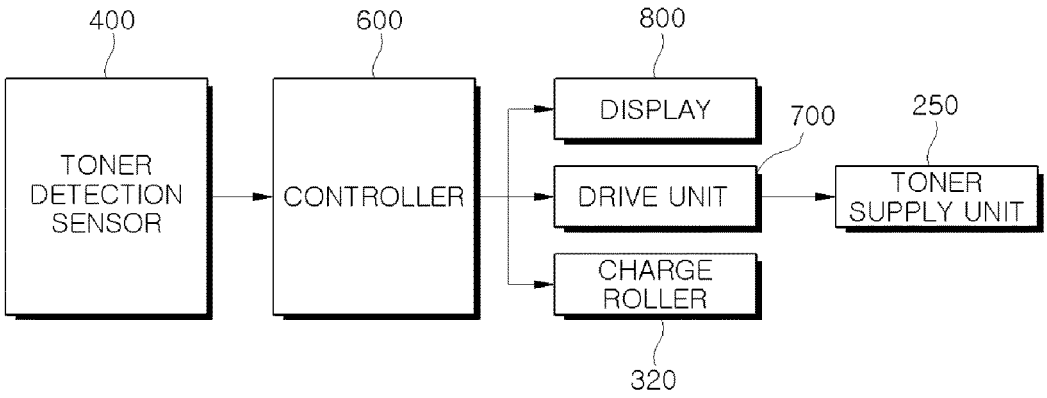
FIG. 9 is a block diagram illustrating an image forming apparatus according to an embodiment of the present disclosure.

FIG. 9 is a block diagram illustrating an image forming apparatus according to an embodiment of the present disclosure.

Referring to FIG. 9, the image forming apparatus 100 according to the embodiment may include a toner detection sensor 400 to detect density of toners T from among the developer in the developing unit 300, a display unit to display information regarding the image forming apparatus 100 thereon, a drive unit to supply drive power to the toner supply unit 250, and a controller 600 to control constituent elements of the image forming apparatus 100.

The controller 600 may determine whether it is impossible for toners T to be supplied from the first toner cartridge 200 currently combined. For example, assuming that toners T contained in the first toner cartridge 200 are completely consumed, if the first toner cartridge 200 is abnormally operated, the controller 600 may confirm the abnormal operation of the first toner cartridge 200.

If it is impossible for the first toner cartridge 200 to supply toners T, the controller 600 may control the display unit to provide an information message indicating manipulation of the second toner cartridge 200 to be combined, instead of the first toner cartridge 200.

In more detail, the controller 600 may determine whether the average coverage belongs to a predetermined reference coverage range. In this case, the reference coverage range may indicate the average coverage range in which the amount of developer is stably maintained. According to the above-mentioned example, the upper limit of the reference coverage may be set to 10%, and the lowest limit of the reference coverage may be set to 2.5%.

In this case, the controller 600 may obtain the average coverage on the basis of the amount of actually used toners T, and the average coverage may also be confirmed according to a user input or internal operation.

If the average coverage is higher than the upper limit of the reference coverage, the controller 600 may determine the presence of a sufficient amount of carriers C in the developer. Therefore, the controller 600 may control the display such that information regarding the close operation of the carrier container 500 of the second toner cartridge 200 to be newly combined may be displayed on the display. After the user confirms the above operation, the moving unit 512 from among the upper cap 510 of the carrier container 500 of the second toner cartridge 200 may move to the second position.

In contrast, if the average coverage is equal to or less than the reference coverage, the controller 600 may determine the insufficient amount of carriers C in the developer. Therefore, the controller 600 may control the display such that information regarding the opening manipulation of the carrier container 500 of the second toner cartridge 200 to be newly combined may be displayed on the display.

Specifically, assuming that the number of carrier containers 500 is set to 2, the controller 600 may control the display in a manner that the opening manipulation information of the carrier container 500 may be displayed in different ways according to whether the average coverage is less than the lowest limit of the reference coverage. For example, assuming that the average coverage is less than the lowest limit of the reference coverage, the controller 600 may control the display unit to display the opening manipulation information of two carrier containers 500. In contrast, assuming that the average coverage is equal to or higher than the lowest limit of the reference coverage, the controller 600 may control the display unit to display the opening manipulation information of only one carrier container 500.

The user may confirm the opening manipulation information displayed on the display unit, and may move the moving unit 512 from among the upper cap 510 of at least one carrier container 500 of the second toner cartridge 200 to a first position.

In addition, the controller 600 may also control the display unit to display specific information indicating whether the second toner cartridge 200 is an imitation (or counterfeit) according to whether the carriers C are supplied from the replaced second toner cartridge 200. For this purpose, the controller 600 may also use the detection result of the toner detection sensor 400.

The toner detection sensor 400 is in the developing unit 300, and may represent information regarding density of toners T in the developing unit 300 as the electrical signal. Referring to FIG. 2, the toner detection sensor 400 may be in the developing unit 300 combined with the toner outlet 260 of the toner cartridge 200. As a result, the toner detection sensor 400 may detect the change of toner density according to the toners T supplied from the toner cartridge 200, and may represent the detected change of toner density as the electrical signal. In more detail, the toner detection sensor 400 may generate an electrical signal having a predetermined voltage according to the change of toner density.

The controller 600 may confirm whether the carriers C have been supplied on the basis of the electric signal denoted by the toner detection sensor 400.

Figure 10:
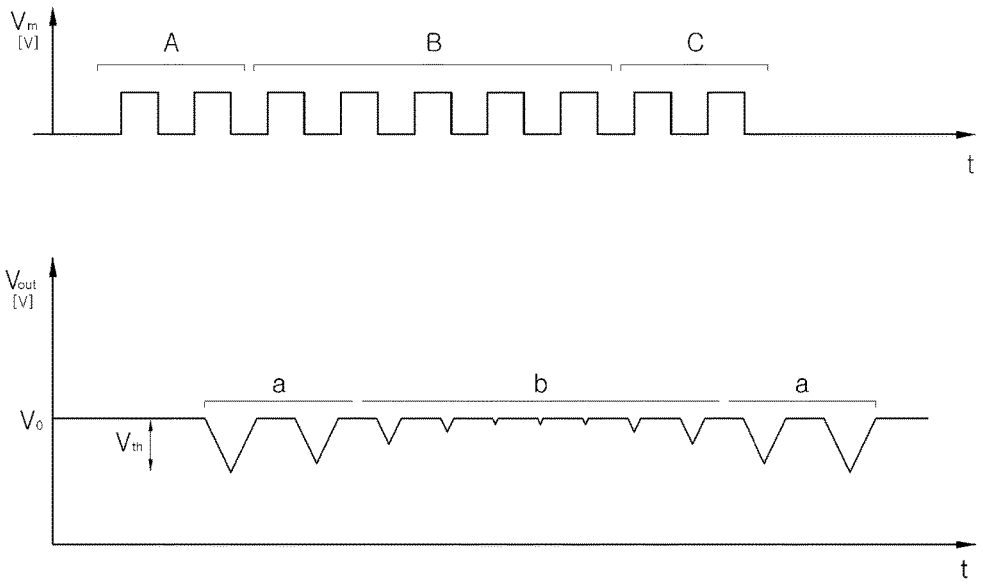
FIG. 10 illustrates a drive signal of the image forming apparatus and an output signal of a toner detection sensor according to an embodiment of the present disclosure.

FIG. 10 illustrates a drive signal of the image forming apparatus and an output signal of the toner detection sensor according to an embodiment of the present disclosure. In FIG. 10, a signal shown in an upper part may denote a drive signal, and a signal shown in a lower part may denote an output signal of the toner detection sensor 400. In addition, the resultant signal of the section A, the resultant signal of the section B, and the resultant signal of the section C may represent the section (a), the section (b), and the section (c), respectively.

After the second toner cartridge 200 is combined, the controller 600 may output a drive signal of FIG. 10 to the drive unit 700. The drive unit 700 may rotate the toner supply unit 250 according to the drive signal, such that toners T may be supplied from the toner cartridge 200 to the developing unit 300.

From among the drive signals of FIG. 10, the section A may represent a time period in which toners T are supplied, the section B may represent a time period in which much more carriers C than the toners T are supplied, and the section C may represent a time period in which toners T are supplied again. That is, after the second toner cartridge 200 is newly combined with the developing unit 300, toners T and carriers C may be sequentially supplied from the toner cartridge 200 to the developing unit 300 in the order of Toners T→Carriers C→Toners T.

As a result, the toner detection sensor 400 may detect the change of density of toners in the developer in the developing unit 300. As can be seen from the section (a) from among the output signals of the toner detection sensor 400 of FIG. 10, the output signal may be reduced by a predetermined level (Vth) according to supply of toners T, and may then restore to the original level. If toners T of 0.3 g are supplied by a single supply operation of toners T, the level of the output signal may be reduced by 0.25V.

However, as can be seen from the section (b) of the output signal, it may be confirmed that the output signal corresponding to the voltage level (Vth) or less has occurred. After the toner cartridge 200 is replaced with another cartridge, the density of toners T from among the developer in the developing unit 300 may be at an excessively low level. Therefore, although the carriers C are supplied, the change of density of toners T is excessively low, such that reduction of the output level of the output signal may be lessened.

In addition, as can be seen from the section (c) in the output signal, the level of the output signal may be reduced by a predetermined level (Vth) according to supply of toners T, and may then be restored to an original level. After the entire amount of carriers in the carrier container 500 is supplied, toners T are supplied from the toner cartridge 200, such that the output signal may be restored to an original level.

In accordance with the above-mentioned method, if it is determined that the carriers C are not supplied, the controller 600 may determine whether the average coverage exceeds the upper limit of the reference coverage range. If the average coverage exceeds the upper limit of the reference coverage range, this means that there is a sufficient amount of carriers C of the developer, such that the controller 600 may determine that the carriers C are not supplied from the second toner cartridge 200.

However, assuming that the average coverage is equal to or less than the reference coverage, this means that the carriers C are not supplied although it is necessary to supply the carriers C from the second toner cartridge 200. In this case, the controller 600 may determine the second toner cartridge 200 to be an imitation toner cartridge 200 in which the carrier container 500 is not included, and may also control the display unit to display the determined information.

In accordance with the above-mentioned method, assuming that the carriers C are supplied, the controller 600 may control a surface potential of the photoconductor 130 such that the amount of developer is controlled.

In more detail, the controller 600 may determine whether the amount of developer is higher than the first reference amount of developer. If the amount of developer is equal to or less than the first reference amount of developer, the controller 600 may determine that the amount of developer is stably maintained.

However, assuming that the amount of developer is higher than the first reference amount of developer, the controller 600 may determine that the amount of the carriers C from among the developer is equal to or higher than a necessary amount of the carriers C. Therefore, the controller 600 may remove the carriers C. For example, the controller 600 may apply a predetermined potential to the surface of the photoconductor 130 using the charge roller 320. In this case, the predetermined potential may denote a potential at which the carriers C are developed onto the photoconductor 130. For example, the predetermined potential may be determined in a manner that a difference between the developing potential and the predetermined potential is 200V.

As a result, some carriers C from among the developer are developed onto the photoconductor 130, such that some carriers C may be removed from the developer.

Heretofore, the exemplary case in which the closed carrier container 500 is opened once according to user manipulation has been described. In contrast, the controller 600 may also control the opening or closing operation of the carrier container 500 at any time.

For this purpose, the controller 600 may use not only the amount of developer in the developing unit 300, but also the average coverage. In more detail, the controller 600 may open or close the carrier container 500 in such a manner that the amount of developer in the developing unit 300 is between the first reference amount of developer and the second reference amount of developer, and the controller 600 may consider the average coverage.

For example, assuming that the amount of developer is equal to or less than a reference amount of developer and the average coverage is equal to or less than the first reference coverage, the controller 600 may open the carrier container 500 such that the carriers C may be supplied to the developing unit 300.

In FIG. 9, the controller 600 may be implemented as hardware such as a microprocessor, or may also be implemented as software executed by a processor or running on hardware.

Figure 11:
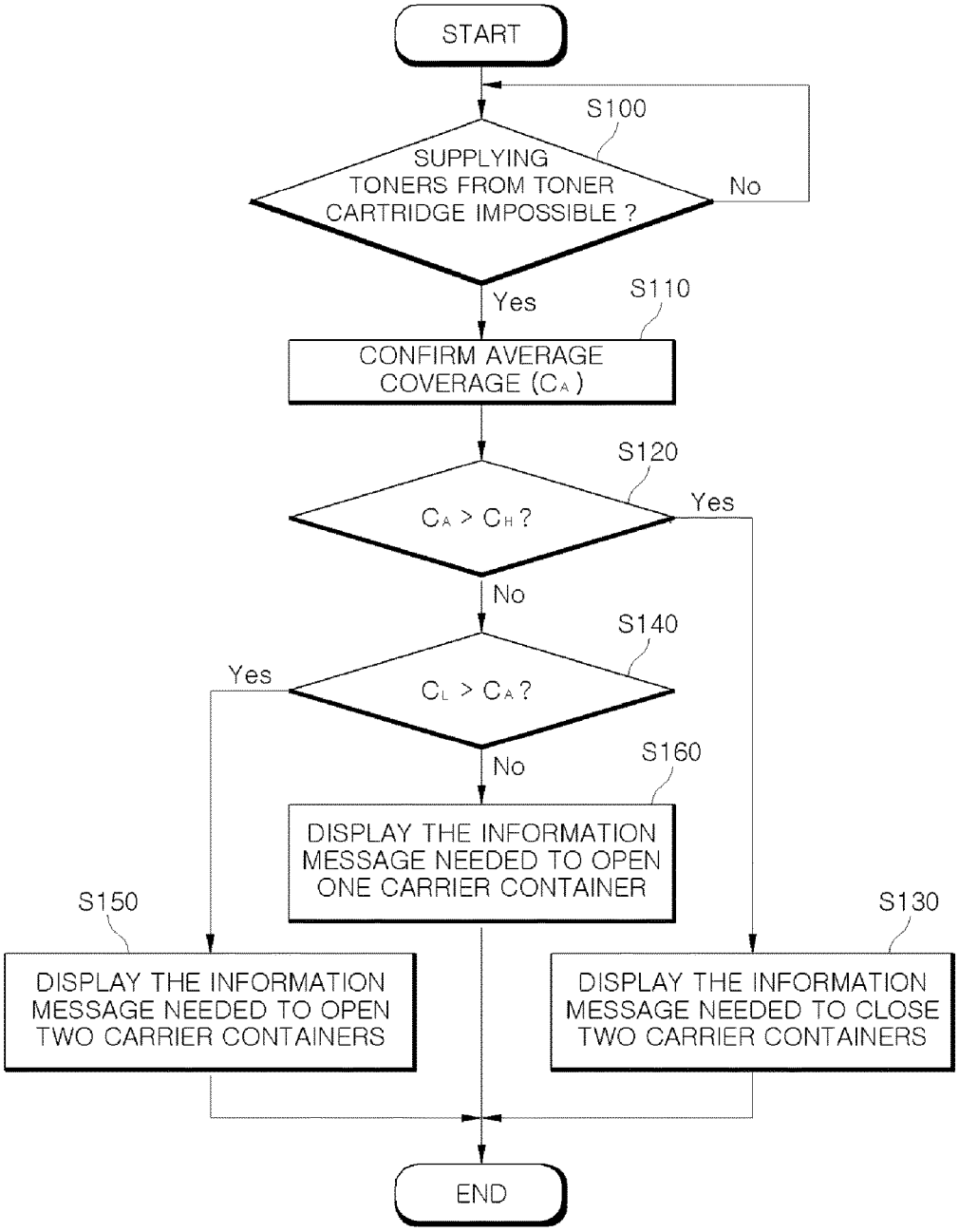
FIG. 11 is a block diagram illustrating an image forming apparatus according to an embodiment of the present disclosure.

FIG. 11 is a block diagram illustrating an image forming apparatus according to an embodiment of the present disclosure. In more detail, FIG. 11 is a control block diagram illustrating the image forming apparatus 100, for example, just before the toner cartridge 200 is replaced. FIG. 11 assumes that the image forming apparatus 100 includes two carrier containers 500 for convenience of description and better understanding of the present disclosure.

The image forming apparatus 100 may determine whether it is impossible to supply toners T from the toner cartridge 200 combined with the developing unit 300 (S100). In this case, the case in which it is impossible to supply toners T may include a first case in which toners T contained in the toner cartridge 200 are completely consumed, or a second case in which it is impossible for the toner cartridge 200 to normally operate. If it is impossible to supply toners T from the toner cartridge 200, the image forming apparatus 100 may repeatedly confirm the above-mentioned situation.

In contrast, if it is impossible to supply toners T from the toner cartridge 200, the image forming apparatus 100 may confirm the average coverage $C_A$ (S110). The average coverage may denote coverage of toners T with respect to the entire area of sheet P, and may be determined either by internal calculation of the image forming apparatus 100 or by user input.

Thereafter, the image forming apparatus 100 may determine whether the average coverage is higher than the first reference coverage ($C_H$) (S120). In this case, the first reference coverage ($C_H$) may denote the upper limit of a normal average coverage.

If the average coverage ($C_A$) is higher than the first reference coverage ($C_H$), the image forming apparatus 100 may display an information message indicating that two carrier containers 500 of the toner cartridge 200 to be newly combined will be closed (S130). If the average coverage ($C_A$) is higher than the first reference coverage ($C_H$), this means that a sufficient amount of carriers C is present in the developer.

In contrast, assuming that the average coverage ($C_A$) is equal to or less than the first reference coverage ($C_H$), the image forming apparatus 100 may determine whether the average coverage ($C_A$) is less than the second reference coverage ($C_L$) (S140). In this case, the second reference coverage ($C_L$) may denote the lowest limit of the normal average coverage.

If the average coverage ($C_A$) is less than the second reference coverage ($C_L$), the image forming apparatus 100 may display an information message indicating that two carrier containers 500 of the toner cartridge to be newly combined will be opened (S150). If the average coverage ($C_A$) is less than the second reference coverage ($C_L$), this means that there is an insufficient amount of carriers (C) in the developer.

In contrast, assuming that the average coverage ($C_A$) is equal to or higher than the second reference coverage ($C_L$), the image forming apparatus 100 may display an information message indicating that only one carrier container 500 of the toner cartridge 200 to be newly combined will be opened (S160). Since the average coverage ($C_A$) belongs to a normal range, the carriers C are supplied from only one carrier container 500, such that the normal amount of developer can be maintained.

Figure 12:
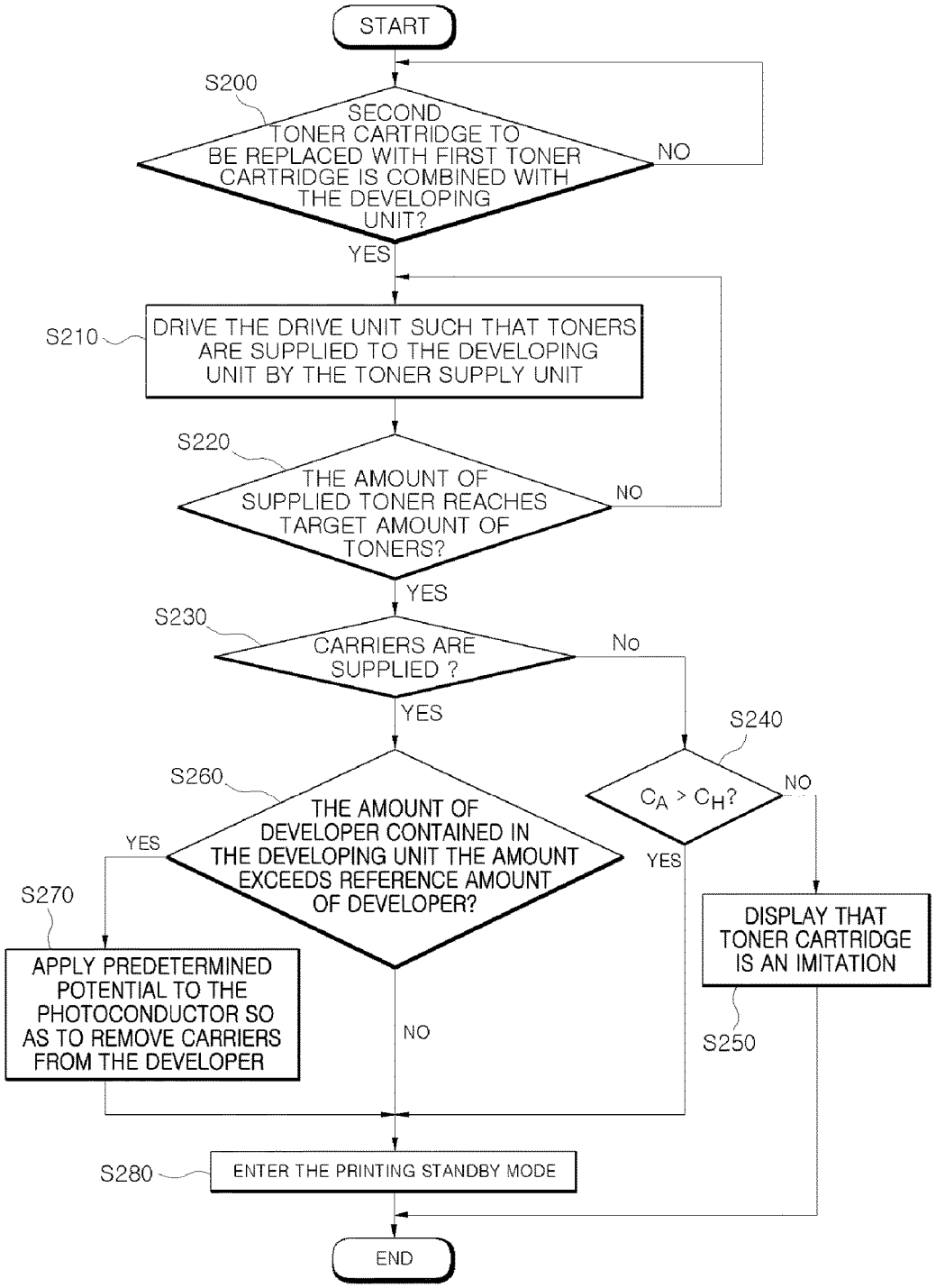
FIG. 12 is a block diagram illustrating an image forming apparatus according to another embodiment of the present disclosure.

FIG. 12 is a block diagram illustrating an image forming apparatus according to another embodiment of the present disclosure. In more detail, FIG. 12 is a control block diagram illustrating the image forming apparatus 100 just after the toner cartridge 200 is replaced.

Referring to FIG. 12, the image forming apparatus 100 may determine whether the second toner cartridge 200 replaced with the first toner cartridge 200 is combined with the developing unit 300 (S200). For example, the image forming apparatus 100 may determine whether the toner cartridge 200 is replaced or not according to whether the front cover mounted to the main body is first opened and then closed. If the second toner cartridge 200 is not combined with the developing unit 300, the image forming apparatus 100 may repeatedly confirm the above-mentioned situation.

In contrast, assuming that the second toner cartridge 200 is combined with the developing unit 300, the image forming apparatus 100 may operate the drive unit 700 such that toners T can be supplied to the developing unit 300 by the toner supply unit 250 (S210). For this purpose, the controller 600 may transmit a drive signal to the drive unit 700, and the drive unit 700 may be controlled according to the pulse width modulation (PWM) scheme.

Thereafter, the image forming apparatus 100 may determine whether the supplied amount of supplied toners T reaches the target amount of toners T (S220). In this case, the target amount of toners T may denote a minimum amount of toners T to be supplied to the developing unit 300. If the amount of supplied toners T does not reach the target amount of toners T, the image forming apparatus 100 may operate the drive unit 700 such that toners T are resupplied.

In contrast, assuming that the amount of supplied toners T reaches the target amount of toners T, the image forming apparatus 100 may confirm that the carriers have been supplied to the developing unit 300 (S230). For this purpose, the image forming apparatus 100 may use the detection result of the toner detection sensor 400.

If the carriers C are not supplied, the image forming apparatus 100 may determine whether the average coverage ($C_A$) is higher than the first reference coverage ($C_H$) (S240). If the average coverage ($C_A$) does not exceed the first reference coverage ($C_H$), this means that the carriers C are not supplied although supply of carriers C is needed, such that the image forming apparatus 100 may display information indicating that the second toner cartridge 200 is an imitation (or counterfeit) (S250). In contrast, assuming that the average coverage ($C_A$) is equal to or less than the first reference coverage ($C_H$), this means that the carriers C are abnormally supplied, such that the image forming apparatus may enter the printing standby mode (S280).

In the meantime, if supply of the carriers C is confirmed, the image forming apparatus 100 may determine whether the amount of developer in the developing unit 300 is higher than the reference amount of developer (S260). In this case, the reference amount of developer may denote the range of a predetermined amount of developer. In the case in which the amount of developer is higher than the reference amount of developer, this means that the amount of developer exceeds the upper limit of the range of the amount of developer.

If the amount of developer exceeds the reference amount of developer, the image forming apparatus 100 may apply a predetermined potential to the photoconductor 130 so as to remove the carriers C from the developer (S270). As a result, some carriers C are developed onto the photoconductor 130, such that the amount of carriers C in the developer may be removed.

In contrast, if the amount of developer does not exceed the reference amount of developer, or after some carriers C are developed, the image forming apparatus 100 may enter the printing standby mode (S280).

As is apparent from the above description, the toner cartridge, the image forming apparatus including the same, and the method for controlling the image forming apparatus according to embodiments do not require an additional power source for carrier supply, and include only the space capable of storing a small amount of carriers, such that the image forming apparatus can be miniaturized and product costs thereof can be greatly reduced.

The toner cartridge, the image forming apparatus including the same, and the method for controlling the image forming apparatus according to embodiments can increase the lifespan of a developer by reducing deterioration of the developer, and can stabilize density of toners, thereby preventing degradation of the image quality.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. An image forming apparatus comprising:

a photoconductor on which an electrostatic latent image is formed; and a developing unit to form a toner image by supplying a toner to the photoconductor; and at least one toner cartridge couplable to the developing unit so as to supply the toner to the developing unit, wherein the at least one toner cartridge includes:

a case, a toner container in the case to contain the toner, a toner outlet to discharge the toner to the developing unit, and a carrier container containing a carrier, the carrier container including one side from which the carrier is dischargeable by applied pressure to the carrier container when the one side is arranged to face toward the toner outlet.

2. The image forming apparatus according to claim 1, wherein the one side of the carrier container forms a carrier discharge unit that is openable or closeable by the applied pressure.

3. The image forming apparatus according to claim 2, wherein the carrier container includes:

a carrier outlet forming unit extended perpendicular to the carrier discharge unit, wherein, if the pressure is applied to one end of the carrier outlet forming unit, an other end of the carrier outlet forming unit passes through the carrier discharge unit, resulting in formation of a carrier outlet through which the carrier is dischargeable, and an upper cap, upon receiving pressure from an external part, to be movable between a first position at which the one end of the carrier outlet forming unit is pressed by the applied pressure and a second position at which the one end of the carrier outlet forming unit is not pressed.

4. The image forming apparatus according to claim 3, further comprising:

a display; and a controller to control the display to display information regarding the toner cartridge.

5. The image forming apparatus according to claim 4, wherein: the controller is to, when a first toner cartridge of the at least one toner cartridge is coupled to the developing unit and not able to supply the toner from the first toner cartridge, control the display to display a position of the upper cap of a second toner cartridge of the at least one toner cartridge to replace the first toner cartridge based on an average coverage, and wherein, if the second toner cartridge includes two carrier containers, the controller is to, if the average coverage exceeds a first reference coverage, control the display to display an information message for commanding the upper cap of one of the two carrier containers to move to the second position, and if the average coverage is less than a second reference coverage, control the display to display an information message for commanding the upper cap of the one of the two carrier containers to move to the first position.

6. The image forming apparatus according to claim 4, further comprising:

a toner detection sensor to detect density of the toner in a developer including the toner and the carrier in the developing unit, wherein the controller determines whether the carrier is supplied to the developing unit using the detection result.

7. The image forming apparatus according to claim 6, wherein:

if the toner cartridge is coupled to the developing unit, and if the controller determines that the carrier is not supplied to the developing unit, the controller is to determine whether the toner cartridge is a genuine toner cartridge based on the average coverage, and controls the display to display the determined result; and if the carrier is not supplied from the toner cartridge, and if the average coverage is equal to or less than a first reference coverage, the controller controls the display to display information indicating that the toner cartridge is not the genuine toner cartridge.

8. The image forming apparatus according to claim 6, wherein:

when the toner cartridge is coupled to the developing unit, if the controller determines that the carrier is supplied to the developing unit, the controller is to determine whether a predetermined electric potential is to be applied to the photoconductor in a manner that a portion of the carrier included in the developer are developed on the photoconductor based on an amount of the developer including the toner and the carrier in the developing unit.

9. The image forming apparatus according to claim 8, wherein, if the controller determines that the carrier is supplied from the toner cartridge, and if the amount of the developer in the developing unit exceeds a reference amount of the developer, the controller is to transmit the predetermined electric potential to the photoconductor.

10. The image forming apparatus according to claim 2, further comprising:

a controller to control the carrier container to open or close the carrier discharge unit based on an amount of a developer including the toner and the carrier in the developing unit and an average coverage, wherein, if the amount of the developer is equal to or less than a reference amount of the developer, and if the average coverage is equal to or less than a first reference coverage, the controller is to control the carrier container to open the carrier outlet formed through the carrier discharge unit.

11. A method for controlling an image forming apparatus including a developing unit to which a toner cartridge including a toner outlet is couplable, the toner cartridge including a carrier container containing a carrier and having a carrier discharge unit through which a carrier outlet is formable to discharge the carrier by applied pressure to the carrier container when the carrier discharge unit is arranged to face toward the toner outlet, the method comprising:

obtaining, by a controller, in response to the toner cartridge being coupled to the developing unit and the carrier outlet being formed through the carrier discharge unit in response to the applied pressure, information regarding the toner cartridge using at least one of an amount of developer including the toner and the carrier in the developing unit, or an average coverage; and displaying, by a display, information regarding the obtained information regarding the toner cartridge.

12. The method according to claim 11, wherein the obtaining the information regarding the toner cartridge includes:

determining, by the controller, whether a first toner cartridge of the at least one toner cartridge is able to supply the toner, when the toner cartridge is coupled to the developing unit, and determining, by the controller, in response to the controller determining that the first toner cartridge is not able to supply the toner, whether a second toner cartridge of the at least one toner cartridge to replace the first toner cartridge needs to be opened or closed based on the average coverage, and the displaying the information regarding the obtained information regarding the toner cartridge includes:

displaying an information message to open or close the second toner cartridge according to the determining whether the second toner cartridge to replace the first toner cartridge needs to be opened or closed based on the average coverage.

13. The method according to claim 12, wherein, if the second toner cartridge includes two carrier containers, the determining whether the second toner cartridge needs to be opened or closed includes:

if the average coverage exceeds a first reference coverage, displaying an information message to close the two carrier containers, and if the average coverage is less than a second reference coverage, displaying an information message to open the two carrier containers.

14. The method according to claim 11, wherein the obtaining the information regarding the toner cartridge includes:

detecting density of the toner included in the developer in the developing unit, and determining whether the carrier is supplied to the developing unit based on the detecting the density of the toner.

15. The method according to claim 14, wherein the obtaining the information regarding the toner cartridge further includes:

if the carrier is not supplied after the at least one toner cartridge is coupled to the developing unit, determining whether the toner cartridge is genuine based on the average coverage, wherein the displaying the information regarding the toner cartridge includes:

displaying information indicating whether the toner cartridge is genuine, and wherein the determining whether the toner cartridge is genuine includes:

in response to determining that the carrier is not supplied from the toner cartridge, if the average coverage is equal to or less than a first reference coverage, determining that the toner cartridge is not genuine.

16. The method according to claim 14, wherein the obtaining the information regarding the toner cartridge further includes:

in response to determining that the carrier is supplied to the developing unit, determining whether the carrier in the developer needs to be removed based on the amount of the developer in the developing unit.

17. The method according to claim 16, wherein the determining whether the carrier needs to be removed includes:

in response to the determining that the carrier is supplied to the developing unit, if the amount of the developer in the developing unit exceeds a reference amount of the developer, determining that the carrier of the developer in the developing unit needs to be removed.

18. The method according to claim 16, further comprising:

in response to determining that the carrier needs to be removed, applying a predetermined electric potential to the photoconductor in a manner that a portion of the carrier in the developing unit are developed on the photoconductor of the image forming apparatus.

19. The method according to claim 11, further comprising:

when the carrier outlet is formed through the carrier discharge unit, opening or closing the carrier outlet formed through the carrier discharge unit based on the obtained information regarding the toner cartridge.

20. The method according to claim 19, wherein the obtaining the information regarding the toner cartridge includes:

determining whether the carrier outlet formed through the carrier discharge unit needs to be opened or closed based on the amount of the developer in the developing unit and the average coverage, wherein the opening or closing the carrier outlet formed through the carrier discharge unit includes:

if the amount of the developer is equal to or less than a predetermined reference amount of the developer, and if the average coverage is equal to or less than a predetermined first reference coverage, opening the carrier outlet formed to the carrier discharge unit.

* * * * *